US005088941A

United States Patent [19]

Nölle

[11] Patent Number: 5,088,941

[45] Date of Patent: Feb. 18, 1992

[54] DEVICE FOR CONNECTING CONDUCTORS TO BATTERY POSTS AND THE LIKE

[75] Inventor: Günther Nölle, Lörrach-Hauingen, Fed. Rep. of Germany

[73] Assignee: Auto-Kabel Hausen GmbH & Co. Betriebs - KG, Hausen Im Wiesental, Fed. Rep. of Germany

[21] Appl. No.: 679,744

[22] Filed: Apr. 3, 1991

[30] Foreign Application Priority Data

Apr. 7, 1990 [DE] Fed. Rep. of Germany ..... 4011378

[51] Int. Cl.[5] ..... H01R 11/26

[52] U.S. Cl. ..... 439/762; 439/772

[58] Field of Search ..... 439/762, 765, 770, 772, 439/773, 754

[56] References Cited

U.S. PATENT DOCUMENTS 4,664,468 5/1987 Woodworth ..... 439/772

FOREIGN PATENT DOCUMENTS 3531014 3/1987 Fed. Rep. of Germany .
1091782 4/1955 France .
882205 11/1961 United Kingdom .

*Primary Examiner*—Paula A. Bradley
*Attorney, Agent, or Firm*—Peter K. Kontler

[57] ABSTRACT

A connector which is used to electrically connect one or more cables with the post of a battery has two jaws which are integral at one of their ends and define a gap with their other ends. The median portions of the jaws define an opening for the post. The other ends of the jaws are movable relative to each other to thereby deform the jaws and move their median portions into and from engagement with a post in the opening. Such movements are effected by a screw or nut which is accessible from the upper sides of the jaws and is rotatable about an axis which is parallel to the axis of the post in the opening. Conversion of rotary movements of the screw or nut into substantially translatory movements of the other ends and median portions of the jaws toward or away from each other is effected by a cam and follower assembly. The assembly can include a cam on the head of a non-rotatable screw and followers on the other ends of the jaws, a cam on one of the jaws and a follower on the other jaw, or a cam on a non-rotatable nut and followers on the other end portions of the jaws.

25 Claims, 3 Drawing Sheets

DEVICE FOR CONNECTING CONDUCTORS TO BATTERY POSTS AND THE LIKE

BACKGROUND OF THE INVENTION

The invention relates to improvements in devices for separably connecting one or more conductors to a terminal, such as the post of a rechargeable accumulator or battery in a motor vehicle. More particularly, the invention relates to improvements in connecting devices (hereinafter called connectors) of the type wherein a substantially cylindrical or slightly conical terminal (hereinafter called post) can be engaged by portions of two clamping jaws which are movable relative to each other to thereby increase or reduce and, when necessary, terminate frictional engagement between the post and the jaws.

It is well known to utilize a connector with two jaws which can form-lockingly engage and frictionally adhere to the post of a battery under the hood of a motor vehicle. The arrangement is normally such that the jaws have integral first end portions, second end portions which are separated from each other by a gap, and median portions which jointly define an opening for the post of a battery or the like. The second end portions can be moved toward each other by a bolt-and-nut fastener, which extends at right angles to the axis of the opening, to thereby reduce the width of the gap and hence the size of the opening for the post. As a rule, the width of the slot is less than the diameter of the opening. The head of the bolt engages the exposed side surface of the second end portion of one jaw, and the shank of the bolt extends through untapped holes in the second end portions of both jaws to mate with a nut at the outer side of the second end portion of the other jaw. The jaws are elastically deformable so that they tend to move their second end portions away from each other, i.e., they tend to increase the width of the gap, so that the connector can be readily slipped off the post upon rotation of the bolt in a direction to permit movement of the second end portions away from each other. A drawback of such connectors is that the nut must be held against rotation while the head of the bolt is rotated in a direction to move the second end portions of the jaws toward each other or to permit movement of the second end portions away from one another. This renders the just described connector unsuitable for manipulation by an automaton (robot). Moreover, the head of the bolt and the nut occupy a substantial amount of space at the exposed sides of the second end portions of jaws. Therefore, it is difficult to provide room for attachment of one or more additional electric cables or other conductors, e.g., to supply electrical energy to various electronic components of a motor vehicle. As a rule, the connector must be dimensioned and configurated in such a way that it does not extend laterally beyond the outline of the battery; this renders it possible to apply a customary cover or cap which overlies the battery in a motor vehicle.

Published German patent application No. 35 31 014 of Welcker discloses a connector wherein the second end portions of the jaws are integral with each other and define a portion of a tapped bore which is parallel to the axis of the opening for the battery post. The tapped bore can receive a screw which serves to displace an insert bounding a portion of the opening for the post so that the insert bears against the post in the opening as long as the screw is properly received in the tapped bore.

A drawback of the connector of Welcker is that the jaws are not elastically deformable and, therefore, only a relatively small portion of the peripheral surface of the post in the opening is engaged by the jaws. A further relatively small portion of the post is engaged by the insert. Mere partial engagement between the peripheral surface of the post on the one hand and the jaws and the insert on the other hand is undesirable, particularly in connection with the posts of batteries in motor vehicles, because repeated and practically continuous vibration of the battery, when the engine is on, is likely to loosen the connector after a relatively short period of use. The establishment of a highly pronounced clamping force is to no avail; in addition, this can result in undesirable permanent deformation of the relatively soft battery post.

French Pat. No. 1.091.782 to Quentin discloses a connector which is similar to the connector of Welcker, except that the insert is integrally connected to the second end portion of one of the jaws by a flexible web so that the insert can change its position relative to the jaws and relative to the battery post in the opening between the jaws when the screw (which has a conical shank) is driven home. The drawbacks of the connector of Ouentin are the same as those of the connector which is disclosed by Welcker.

British Pat. No. 882,205 to Renault describes a connector which is a modified version of the connector of Ouentin. The connector of Renault does not employ a screw or bolt but rather a rotary shaft with radially extending lobes which can dislodge a blade so that the latter engages a portion of the battery post in the opening between the median portions of the jaws. The jaws are not movable relative to each other.

OBJECTS OF THE INVENTION

An object of the invention is to provide a simple, compact and inexpensive connector which can be manipulated by an automaton and is less likely to become accidentally disengaged from a terminal (such as a battery post) than heretofore known connectors.

Another object of the invention is to provide a connector which exhibits the advantages of connectors having elastically deformable jaws and of connectors wherein the means for clampinq the terminal in its opening can extend in parallelism with the axis of the opening.

A further object of the invention is to provide a connector wherein the jaws can reliably engage the entire peripheral surface or at least the major part of the peripheral surface of the terminal in the opening between the jaws.

An additional object of the invention is to provide a connector which provides ample room for attachment to two or more conductors.

Still another object of the invention is to provide novel and improved jaws for use in the above outlined connector.

Another object of the invention is to provide novel and improved means for moving portions of the jaws relative to each other for the purpose of clampingly engaging or releasing a battery post or another electrical terminal.

A further object of the invention, is to provide a connector which can engage a terminal with a substantial force without risking any, or any appreciable, deformation of the post.

SUMMARY OF THE INVENTION

The invention resides in the provision of a connector for separably securing at least one conductor to a terminal, particularly for connecting one or more electric cables with a battery post. The improved connector comprises two jaws having neighboring first portions (such first portions can be made of one piece and can define one or more holes or apertures for the bare end or ends of one or more electric cables), second portions which are movable relative to each other and relative to the respective first portions and define a gap (e.g., a slot) of variable width, and third portions which are disposed between the respective first and second portions, which are movable (preferably with the respective second portions) relative to each other and relative to the respective first portions, and which define a variable-size terminal-receiving opening having a first axis and communicating with the gap. The connector further comprises means for varying the size of the opening and the width of the gap, and such varying means includes a cam member and a follower member. The members cooperate with the second portions of the jaws and the varying means further comprises means for moving the members relative to each other. Such moving means includes a threaded element having a second axis which is at least substantially parallel to the first axis. The cam and follower members have complementary surfaces (cam faces) which make with the second axis an oblique angle and move the members relative to each other in response to rotation of the threaded element (the latter can constitute a rotary nut or a rotary screw or bolt) to thereby move the second and third portions of one jaw relative to the second and third portions of the other jaw and/or vice versa with attendant changes of the width of the gap and the size of the opening.

If the externally threaded element constitutes a screw or bolt (hereinafter called screw) having an externally threaded shank, one of the cam and follower members can be provided with a tapped hole for the shank so that rotation of the screw entails a movement of the one member relative to the other member and lateral shifting of the second and third portions of the two jaws relative to each other as a result of sliding movement of the surfaces of the two members relative to each other whereby the width of the gap is increased or reduced and the size of the opening is increased or reduced, depending upon the direction of rotation of the screw.

Alternatively, one of the cam and follower members can constitute the head of the screw, and the threaded element then comprises a nut which engages tee other member and meshes with the shank of the screw. In such connector, the screw need not be rotated, i.e., the nut rotates relative to the shank of the screw to thereby move the surface of the one member relative to the surface of the other member with attendant narrowing or widening of the gap and proportional enlargement or reduction of the size of the opening. The arrangement is preferably such that the surface of one of the cam and follower members has two sections which flank the shank of the screw, and the surface of the other member also includes two sections each of which engages a discrete section of the surface of the one member.

The nut can constitute one of the cam and follower members, and the other of these members can include or form part of the second portions of the two jaws. Rotation of the screw then entails a movement of the nut relative to the second portions of the jaws to thereby move the second and third portions of the two jaws toward or away from each other, depending on the direction of rotation of the screw. The second portions of the jaws in such connector can be provided with shoulders or stops which abut the head of the screw. The surface of the other member can include a section on the second portion of each jaw, and the sections of the surface of the nut flank the sections of the surface on the member which includes or forms part of second portions of the jaws. The nut can be designed to be held in form-locking engagement with the second portions of the jaws. The second portions of the jaws and the screw define clearances which surround the shank and communicate with the gap. The sections of the two surfaces can be mirror images of each other with reference to a symmetry plane which includes at least one of the first and second axes. For example, the sections of the two surfaces and the symmetry plane can make angles of substantially 45°; this ensures that the sections of one surface can readily slide along the adjacent sections of the other surface in response to rotation of the screw.

The width of the aforementioned clearances should be sufficient to avoid contact between the shank of the screw and the second portions of the jaws, even in response to maximum possible reduction of the width of the gap (e.g., all the way to zero).

The head of the screw can be received, at least in part, in a recess which is defined by the second portions of the jaws. If the screw is rotatable, its head can be provided with a tool-receiving socket (e.g., a hexagonal or otherwise configurated socket, depending upon the nature of the tool which is used to rotate the screw).

If the nut is a discrete part which meshes with the shank of a rotatable screw, the second portions of the jaws can be provided with recesses (e.g., in the form of cutouts) which can receive at least a portion of the nut, at least when the size of the opening is reduced so that the third portions of the jaws are in frictional engagement with a post which extends into the opening. The arrangement is preferably such that the free end of the shank of a rotary nut is invariably confined in the nut, irrespective of the width of the gap and the size of the opening. This contributes to compactness of the connector.

At least one of the jaws can be provided with at least one extension for attachment to one or more conductors. The extension can be adjacent the third portion of the respective jaw and can be provided with one or more holes or similar apertures for the bare end or bare ends of one or more additional cables.

The screw can be made of stainless steel, and the jaws and the nut can be made of a nonferrous metallic material, e.g., brass.

The gap can be inclined relative to the second axis, and one of the cam and follower members is then integral with the second portion of one jaw and the other member is integral with the second portion of the other jaw. The threaded element can include a screw which is rotatably mounted in and has a head engaging one of the jaws. The shank of such screw mates with the second portion of the other jaw. The surfaces of the cam and follower members flank the inclined gap and slide along each other in response to a reduction of the width of the gap to zero as a result of rotation of the screw to move the second portions of the jaws toward and against each other. The head and the shank of the screw are then mounted in their jaw with freedom of lateral movement at right angles to the second axis; this enables the two surfaces to slide relative to each other and to vary the size of the opening when the width of the gap is already reduced to zero but the screw continues to rotate in a direction to move the internally threaded second portion toward the head.

The novel features which are considered as characteristic of the invention are set forth in particular in the appended claims. The improved connector itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
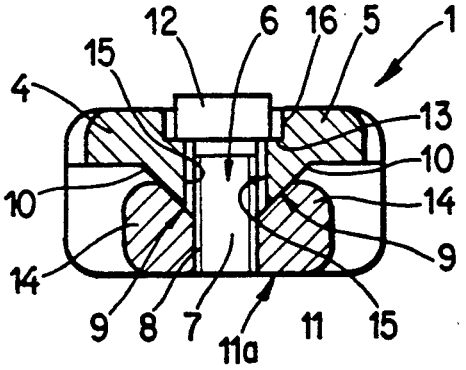
FIG. 1 is a transverse sectional view of a connector which embodies one form of the invention, the section being taken in the direction of arrows as seen from the line I—I of FIG. 2 and the shank of the screw being in mesh with a substantially U-shaped nut which can move the movable portions of the jaws toward each other in response to rotation of the screw.
Figure 3:
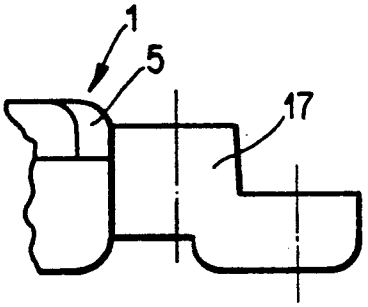
FIG. 3 is a fragmentary elevational view of a modified jaw which can be used in the improved connector and can be connected with a plurality of conductors.
Figure 2:
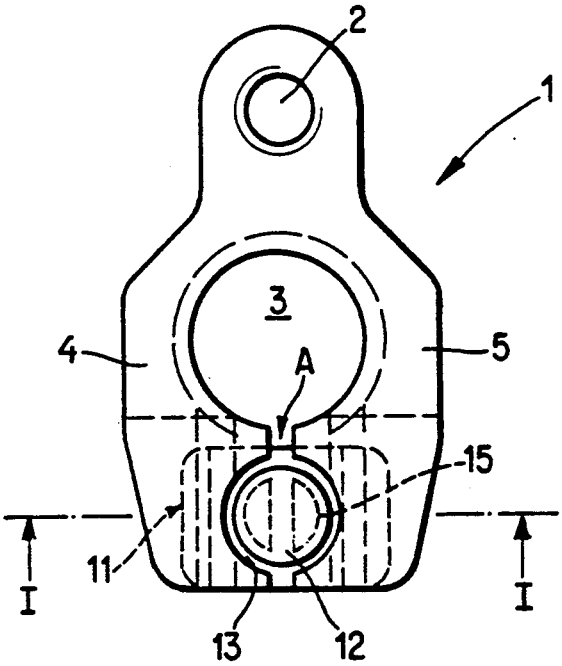
FIG. 2 is a plan view of the connector which is shown in FIG. 1.
Figure 4:
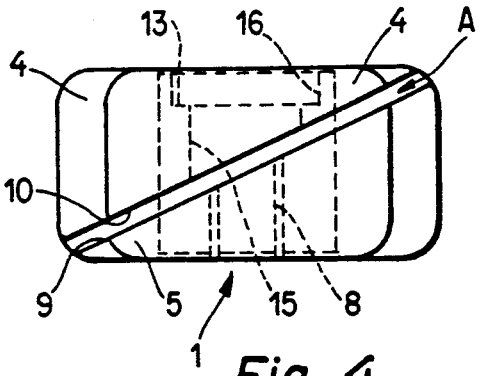
FIG. 4 is a front elevational view of a further connector which does not employ a discrete nut and wherein the cooperating cam faces are provided on the second portions of the jaws.

FIGS. 1 to 3 show a connector 1 which can be used to separably secure one or more conductors (particularly electric cables) to a terminal, such as a customary cylindrical or slightly conical post of a battery for use in a motor vehicle. The connector 1 comprises two jaws or claws 4, 5 having neighboring (preferably integral) first portions defining a hole 2 for reception of a cable (not shown), second portions which are remote from the hole 2 and define a clearance or gap A of variable width, and third portions which are located between the first and second portions and define a variable-size opening 3 for reception of a terminal post, not shown. The connector 1 further comprises means for varying the size of the opening 3 to thereby move the third portions of the jaws 4, 5 into pronounced engagement with, or to disengage the jaws from, the post in the opening 3. Such variation of the size of the opening 3 entails a change in the width of the gap A between the second portions of the jaws 4 and 5. The moving means includes a screw 6 which is mounted in the region of the gap A and is rotatable about an axis which is at least substantially parallel to the axis of the opening 3, i.e., to the axis of the post which is to be received in such opening and to be engaged by the jaws 4, 5 to thus establish an electrical connection between the post and a cable extending into and being held in the hole 2.

Each of the two jaws 4, 5 surrounds approximately or exactly one-half of the opening 3, and the width of the gap A is or can be reduced to zero or close to zero when the size of the opening 3 has been reduced sufficiently to ensure the establishment of strong frictional engagement between the third (median) portions of the jaws 4, 5 and the post in the opening 3. The material of the jaws 4, 5 is at least slightly resilient, and the second and third portions of the jaws tend to move away from each other so as to increase the size of the opening 3 and the width of the gap A and to thereby permit convenient introduction of a post into the opening 3 when the second portions of the jaws are free to move away from each other with attendant increase in the width of the gap A. A narrowing of the gap A entails deformation of the jaws 4 and 5, particularly or mainly in the region between the hole 2 and the opening 3.

In addition to the screw 6, the moving means comprises a cam member in the form of a nut 11 having an internal thread 8 in mesh with the external thread on a shank 7 forming part of the screw 6, and a follower member which, in the connector 1, includes parts of or entire second portions of the jaws 4, 5. Such second portions of the jaws 4 and 5 cooperate with the head 12 of the screw 6. The cam member or nut 11 has a surface or cam face with two mutually inclined sections 9 which make an obtuse angle with the axis of the screw 6 and abut similarly inclined sections 10 of surfaces or cam faces on the second portions of the jaws 4, 5. When the screw 6 is rotated by a suitable tool in a direction to move the nut 11 upwardly, as seen in FIG. 1, the cam face sections 9 slide along the respective cam face sections 10 and cause the second portions of the jaws 4, 5 to move toward each other with attendant reduction of the width of the gap A. This entails a reduction of the size of the opening 3 so that the third or median portions of the jaws 4, 5 engage the post in the opening 3 and establish a reliable electrical connection between such post and the cable which extends into the hole 2. The sections 9, 10 of the cam faces or surfaces cooperate to convert axial movements of the nut 11 into radial movements of the second and third portions of the jaws 4, 5, i.e., into movements of the second and third portions of the jaws toward or away from each other, depending upon the direction of rotation of the screw 6.

The nut 11 can have a single conical cam face or surface which is provided in the inner end portion 14 of the nut (namely in that end portion which is nearer to the head 12), and the cam face sections 10 are then complementary conical surfaces one of which is provided on the second portion of the jaw 4 and the other of which is provided on the second portion of the jaw 5. The second portions of the jaws 4 and 5 surround the shank 7 of the screw 6 with a certain clearance (shown at 15) to ensure that the second portions can move toward each other (in order to reduce the width of the gap A and hence the size of the opening 3) when the nut 11 is caused to move upwardly, i.e., toward the head 12. The head 12 is at least partially received in a composite recess 16 which is provided therefor in the second portions of the jaws 4, 5 and extends to a two-piece internal shoulder 13 serving as an abutment or stop for the inner end face of the head 12. The arrangement is or can be such that the exposed end face of the head 12 is at least substantially coplanar with, or at least close to, the adjacent sides of the jaws 4, 5 and that the exposed outer end face 11*a* of the nut 11 is at least substantially flush with the adjacent sides of the jaws 4, 5 when the size of the opening 3 is reduced so that the third or median portions of the jaws firmly engage a post.

The sections 9, 10 of the surfaces or cam faces establish a form-locking connection between the nut 11 and the adjacent second portions of the jaws 4, 5, and the width of the gap A decreases automatically and gradually as the nut 11 moves closer to the head 12 of the screw 6 when the latter is rotated in a sense to move the nut 11 upwardly, as seen in FIG. 1.

FIG. 2 shows that the nut 11 can have a polygonal (e.g., square or rectangular) outline. Furthermore, the sections 9, 10 of the cam faces need not be conical surfaces; they can extend from the outer end of the gap A toward the opening 3. All that counts is to ensure that a cam face 9 or several sections of such cam face cause the cam face 10 or several sections of such cam face to move relative to each other when the screw 6 is rotated in a direction to move the nut 11 toward the head 12. The illustrated sections 10 of the cam face on the jaws 4, 5 are preferably mirror images of each other with reference to a plane which includes the axes of the opening 3 and screw 6. The same preferably applies for the two halves or sections 9 of or a single cam face on the nut 11. Such design of the cam faces ensures that the second portions of the jaws 4, 5 move toward each other at a predictable uniform rate when the screw 6 is rotated in a sense to reduce the width of the gap A. For example, the inclination of sections 9, 10 of the two cam faces relative to the axis of the screw 6 can be in the range of 45°.

The head 12 of the screw 6 is located at the upper or outer sides of the jaws 4 and 5, i.e., at those sides which are accessible when the jaws surround a post in the opening 3. A polygonal nut 11 is preferred in many instances because it can be installed in the cutouts or recesses at the undersides of the jaws 4, 5 in such a way that it is held against rotation with the shank 7. This simplifies the task of clamping the post between the jaws 4, 5 because the operator need not hold the nut 11 against rotation relative to the jaws while the screw 6 is being rotated to release or to clamp the post in the opening 3. As mentioned above, the width of clearances 15 between the shank 7 and the adjacent second portions of the jaws 4, 5 suffices to ensure that the shank 7 cannot interfere with proper engagement between a post and the third portions of the jaws, i.e., that the second portions of the jaws do not engage the shank 7 while the latter is rotated in a direction to pull the nut 11 toward the head 12. The length of the shank 7 is preferably such that its free end is permanently confined in the nut 11.

The depth of the recess 16 is sufficient to receive the major portion of or the entire head 12 of the screw 6. This ensures that the head 12 need not project upwardly beyond the upper sides of the second portions of the jaws 4, 5 when the improved connector 1 is in actual use to electrically connect a post to one or more electric conductors. The exposed side of the head 12 is provided with a customary socket (e.g., a hexagonal socket) to receive the working end of a wrench or any other suitable tool which can turn the screw 6 in a clockwise or counterclockwise direction. The head 12 can have a cylindrical peripheral surface with a diameter which is only slightly smaller than the diameter of the preferably circular recess 16. This is possible if the head 12 is provided with the aforementioned socket, i.e., if rotation of the screw 6 does not involve the application of a tool to the peripheral surface of the head 12.

As mentioned above, the cutouts or recesses in the undersides of second portions of the jaws 4, 5 are sufficiently deep to accommodate the major portion of or the entire nut 11 when the connector 1 properly engages a post in the opening 3. The exposed surface 11*a* of the nut 11 is then flush or nearly flush with the undersides of the jaws 4, 5; in fact, the surface 11*a* can be located inwardly of the undersides of the second portions of the jaws. The dimensions of the nut 11 and of the cutouts in the undersides of the jaws are preferably selected in such a way that the entire nut is confined in the cutouts even if the opening 3 receives a large-diameter or maximum-diameter post.

FIG. 3 shows that at least one of the jaws 4, 5 can be provided with a lateral extension 17 which can have one or more holes (corresponding to the hole 2) for reception of the bare end or bare ends of one or more additional conductors (e.g., electric cables, not shown). The hole or holes in the extension 17 which is shown in FIG. 3 are readily accessible from above. The jaw 4 can also include at least one extension which is, but need not be, identical with the extension 17 of FIG. 3. Each of two or more conductors can supply electric current to a different current-consuming component in a motor vehicle, e.g., to two or more different electrical or electronic components, not shown. The illustrated extension 17 is adjacent the third or median portion of the jaw 5.

The extension or extensions 17 constitute an optional but desirable feature of the improved connector. Such extension or extensions can be provided on any of the three portions of the jaw 4 or 5, as long as they do not interfere with access to the head 12 of the screw 6. The aperture or apertures of an extension 17 need not be remote from the opening 3 and/or from the recess 16 because the space requirements of the tool which is used to rotate the screw 6 are small. This contributes to compactness of the connector and renders it possible to provide for attachment of any desired practical number of additional electrical conductors.

The jaws 4, 5 and the nut 11 can be made of a nonferrous metallic material, e.g., brass. The screw 6 can be made of stainless steel. Such combination has been found to be highly corrosion-resistant for extended periods of time. Therefore, the connector can be detached from a post after a long period of use.

FIGS. 4 to 6*b* show certain details of a second connector 1 which does not employ a discrete nut. All such parts of this second connector which are identical with or clearly analogous to the corresponding parts of the connector 1 of FIGS. 1 and 2 are denoted by similar reference characters. Rather than defining a gap in a plane which includes the axis of the screw 6, the jaws 4 and 5 of the connector 1 of FIGS. 4 to 6*b* define a gap A which is inclined with reference to such axis (see particularly FIGS. 4 and 6*a*). The cam member is constituted by the second portion of the jaw 4 or 5, and the follower member is constituted by the second portion of the jaw 5 or 4. A single cam face or surface 9 is provided on the jaw 5 and a single cam face or surface 10 is provided on the jaw 4. The opening 3 is slightly conical (see FIGS. 5 and 6) and is again defined by the median or third portions of the jaws 4 and 5. This opening is bounded by two circumferentially complete internal surfaces, one in the jaw 4 and the other in the jaw 5. The recess 16 for the head of the screw 6 is provided in the upper side of the jaw 4, and the second portion of the jaw 5 has a bore or hole which is surrounded by an internal thread 8 meshing with the external thread of the shank of the screw 6.

Figure 6A:
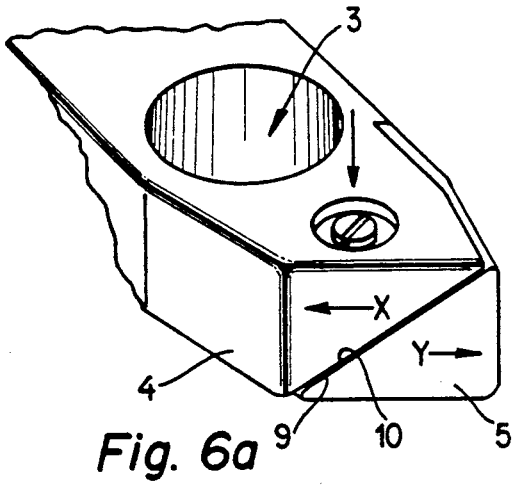
FIG. 6*a* is a fragmentary perspective view of the jaws in the connector of FIGS. 4–6, the jaws being shown in positions they assume when their median portions engage a post.
Figure 5:
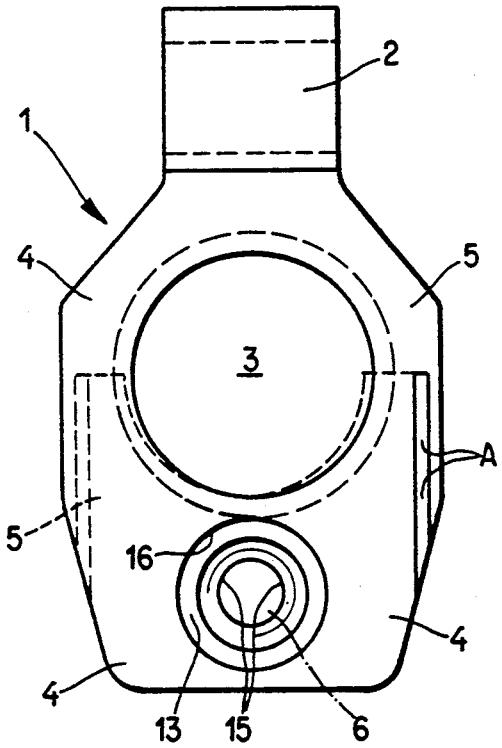
FIG. 5 is a plan view of the connector which is shown in FIG. 4.
Figure 6:
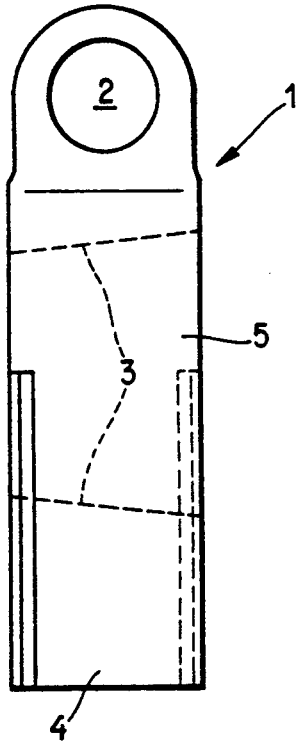
FIG. 6 is a side elevational view of the connector of FIGS. 4 and 5.
Figure 6B:
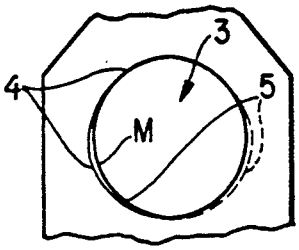
FIG. 6*b* is a plan view of a portion of FIG. 6*a*, showing the positions of surfaces bounding the post-receiving opening prior and subsequent to deformation of the jaws.

When the screw 6 is rotated in a direction to reduce the width of the gap A, the surfaces 9, 10 begin to move toward and thereupon slide relative to each other to thereby reduce the size of the opening 3 in a manner as shown in FIG. 6*b* so that the third or median portions of the jaws 4, 5 clamp a post which extends into the opening 3. The screw 6 is received in the second portion of the jaw 4 with a certain amount of lateral play (note the clearance 15) to provide room for sliding movement of the surfaces 9 and 10 relative to each other when the width of the gap A is already reduced to zero and the screw 6 continues to rotate in a direction to move the internal thread 8 of the second portion of the jaw 5 toward the head of the screw. This is shown in FIG. 6*a* wherein the arrow X indicates the direction of movement of the upper jaw 4 and the arrow Y indicates the direction of movement of the lower jaw 5 relative to the upper jaw after the width of the gap A has been reduced to zero. This results in a distortion of the composite surface surrounding the opening 3, i.e., in desirable pronounced frictional engagement between the third portions of the jaws 4, 5 on the one hand and the peripheral surface of a post in the opening 3 on the other hand.

Figure 7:
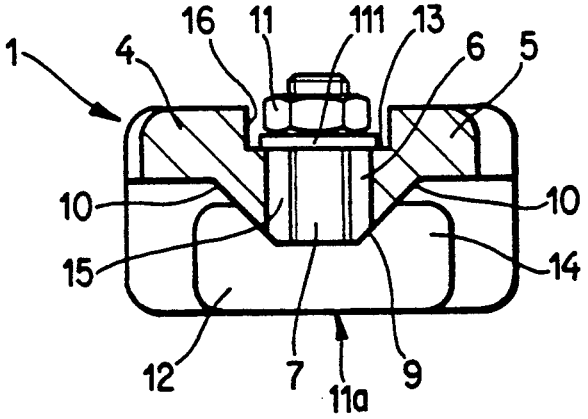
FIG. 7 is a sectional view similar to that of FIG. 1 but showing a further connector wherein the head of the screw constitutes a follower member or a cam member.
Figure 8:
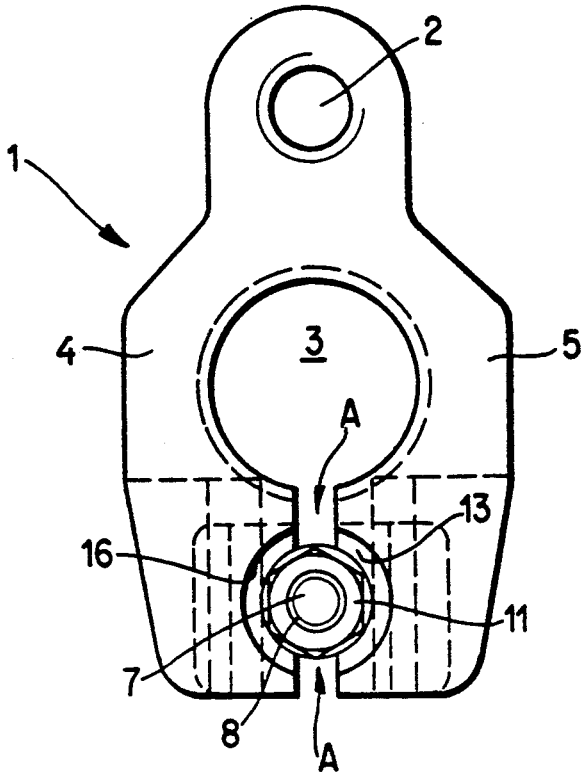
FIG. 8 is a plan view of the connector which is shown in FIG. 7.

FIGS. 7 and 8 illustrate a third connector 1 which constitutes a modification of the connector of FIGS. 1 and 2. The difference is that the head 12 of the screw 6 is provided with cam face sections 9 which cooperate with the cam face sections 10 of the second portions of the jaws 4 and 5. Thus, the head 12 can be said to constitute a cam member which cooperates with a two-piece follower member including the second portions of the jaws 4 and 5. The nut 11 meshes with the shank 7 of the screw 6 and is rotatable in the recess 16. The nut 11 of FIGS. 7 and 8 has a polygonal peripheral surface with six facets two or more of which are engageable by a standard wrench to rotate the nut relative to the shank 7 and to thus draw the head 12 toward the upper sides of the jaws 4 and 5, i.e., toward the recess 16. The latter is dimensioned with a view to provide room for insertion of a tool which can engage two or more facets at the periphery of the nut 11.

In FIG. 7, the screw 6 is to be inserted from below so that its shank 7 extends upwardly through the clearance 15 between the second portions of the jaws 4, 5 and to receive the nut 11. The latter engages a washer 111 which abuts the two-piece internal shoulder 13 at the bottom of the composite recess 16. The cooperating sections 9, 10 of the two cam faces convert axial movements of the shank 7 into radial movements of second portions of the nuts 4, 5 to thereby change the width of the gap A and the size of the opening 3 for the post of a battery or the like.

In each of the illustrated embodiments of the connector 1, the head 12 (FIGS. 1 to 6*b*) or the nut 11 (FIGS. 7–8) is preferably accessible to an automaton so that the attachment of the improved connector 1 to or its detachment from a post can be carried out in a fully automatic way in an assembly plant for motor vehicles or in other automated plants.

An important advantage of the connectors which are shown in FIGS. 1–2 and 7–8 is that the nut 11 (FIGS. 1–2) need not be held against rotation while the screw 6 is rotated to move the second portions of the jaws 4, 5 relative to each other, and that the screw 6 (FIGS. 7 and 8) need not be held against rotation while the nut 11 is rotated to move the second portions of the jaws relative to one another. This simplifies the task of engaging the connector with or of disengaging the connector from a post which extends into the opening 3. Each of the illustrated connectors exhibits the advantage that the rotary threaded element is accessible at the upper side of the connector, i.e., at that side which is accessible anyway, so that the transmission of torque to the rotary element (the screw 6 in the embodiments of FIGS. 1 to 6*b* and the nut 11 in the embodiment of FIGS. 7–8) can be carried out by resorting to an automaton. In contrast to the aforediscussed conventional connectors with elements which are rotatable about axes extending in parallelism with the axis of the opening for the post, the rotary element 6 or 11 of the improved connector serves to move certain portions of two elastically deformable jaws relative to each other to thus ensure the establishment of large-area contact between the jaws and the post.

The connectors of FIGS. 1–3 and 7–8 exhibit the advantage that, if the sections 10 of the one cam face contact the sections 9 of the other cam face when the size of the opening 3 suffices to receive a post, rotation of the screw 6 (FIGS. 1–3) or nut 11 (FIGS. 7–8) immediately results in a movement of median portions of the jaws 4, 5 relative to each other, i.e., the width of the gap A need not be reduced to zero before the median portions of the jaws start their movement toward each other and against the peripheral surface of a post in the opening 3. These connectors further exhibit the advantage that the second portions of the jaws 4, 5 cooperate with the sections 9 of the cam face on the nut 11 (FIGS. 1–3) or on the head 12 (FIGS. 7–8) to prevent rotation of the nut 11 while the screw 6 of FIGS. 1–2 is rotated and to prevent rotation of the screw 6 (FIGS. 7–8) when the nut 11 is rotated.

It is clear that the improved connector need not be manipulated by an automaton, i.e., it is equally possible to employ a manually operated tool to rotate the screw 6 of FIGS. 1–6*b* or the nut 11 of FIGS. 7–8. The positioning of the head 12 of the screw 6 or of the nut 11 at the exposed upper side of the respective connector 1 facilitates manually induced rotation of the screw 6 or nut 11.

The connectors of FIGS. 1–3 and 7–8 exhibit the additional important advantage that the application of clamping force to a post in the opening 3 is at least substantially uniform all the way around the circumference of the post. This is due to the fact that the sections 9 of the cam face on the nut 11 of FIG. 1 or on the head 12 of FIG. 7 are mirror images of each other and cooperate with similarly inclined sections 10 of the composite cam face on the second portions of the jaws 4 and 5. An inclination at the angle of 45° or thereabout has been found to be particularly advantageous because a relatively small angular movement of the rotary element 6 or 11 suffices to effect a pronounced movement of median portions of the jaws 4, 5 toward each other and hence into clamping engagement with a post in the opening 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A connector for separably securing at least one conductor to a terminal, particularly for securing at least one electric cable to a battery post, comprising two jaws having neighboring first portions, second portions movable relative to each other and defining a gap of variable width, and third portions disposed between the respective first and second portions and being movable relative to each other and defining a variable-size terminal-receiving opening having a first axis and communicating with said gap; and means for varying the size of said opening and the width of said gap, including a cam member and a follower member, said members cooperating with the second portions of said jaws, and means for moving said members relative to each other including a threaded element having a second axis which is substantially parallel to said first axis, said members having complementary surfaces which make with said second axis an oblique angle and move said members relative to each other in response to rotation of said threaded element to thereby move the second and third portions of said jaws relative to each other with attendant changes of the width of said gap and the size of said opening.

2. The connector of claim 1, wherein said threaded element comprises a screw having an externally threaded shank, one of said members having a tapped hole for said shank.

3. The connector of claim 1, wherein said threaded element includes a screw having a shank and the second portions of said jaws define with said shank clearances having a width sufficient to avoid contact with the shank in response to maximum reduction of the width of said gap.

4. The connector of claim 1, wherein said threaded element includes a screw having a head, said second portions of said jaws defining a recess for at least a portion of said head.

5. The connector of claim 1, wherein said threaded element includes a screw having a head with a tool-receiving socket.

6. The connector of claim 1, wherein said threaded element includes a screw having a head and an externally threaded shank, one of said members including a nut meshing with said shank and the second portions of said jaws having recesses for at least a portion of said nut.

7. The connector of claim 1, wherein said threaded element includes a screw having a shank and one of said members includes a nut in mesh with said shank, said screw being rotatable to thereby move the second portions of said jaws toward each other and said shank having a free end which is confined in said nut in each angular position of said screw.

8. The connector of claim 1, wherein said threaded element includes a screw having a head which constitutes one of said members and a nut which meshes with said screw and engages the other of said members.

9. The connector of claim 8, wherein the surface of said one member has two sections which flank an externally threaded shank of said screw, the surface of the other of said members having two sections each of which engages one section of the surface of said one member.

10. The connector of claim 1, wherein at least one of said jaws includes at least one extension for attachment to a conductor.

11. The connector of claim 10, wherein said extension is adjacent the third portion of said at least one jaw.

12. The connector of claim 1, wherein said threaded element includes a screw of stainless steel and one of said members includes a nut mating with said screw, said nut and said jaws containing a nonferrous metallic material.

13. The connector of claim 12, wherein said nonferrous metallic material is brass.

14. The connector of claim 1, wherein said gap is inclined relative to said second axis, one of said members being integral with the second portion of one of said jaws and the other of said members being integral with the other of said jaws.

15. The connector of claim 14, wherein said threaded element includes a screw having a head engaging one of said jaws and an externally threaded shank mating with the other of said jaws.

16. The connector of claim 15, wherein the surfaces of said members flank said gap and engage and slide along each other in response to a reduction of the width of said gap to zero as a result of rotation of said screw to move the second portions of said jaws toward and against each other.

17. The connector of claim 16, wherein said head and said shank have freedom of movement relative to said one jaw in directions at right angles to said second axis.

18. The connector of claim 1, wherein said threaded element includes a screw having an externally threaded shank and a head engaging one of said members, the other of said members including a nut which meshes with said shank.

19. The connector of claim 18, said one member is integral with the second portions of said jaws and said second portions have shoulders abutting the head of said screw.

20. The connector of claim 19, wherein the surface of said one member includes a section on each of said second portions and the surface of said nut has two sections which flank the sections of the surface of said one member.

21. The connector of claim 20, wherein said nut is in form-locking engagement with the second portions of said jaws.

22. The connector of claim 20, wherein said second portions of said jaws and said screw define clearances which surround said shank and communicate with said gap.

23. The connector of claim 20, wherein the sections of said surfaces are substantial mirror images of each other with reference to a plane including at least one of said axes.

24. The connector of claim 23, wherein said sections of said surfaces and said plane make angles of substantially 45°.

25. A connector for separably securing at least one conductor to a terminal, particularly for securing at least one electric cable to a battery post, comprising two elastically deformable jaws having integral first end portions, second end portions defining a gap of variable width, and third portions disposed between the respective first and second end portions and jointly defining a variable-size terminal-receiving opening having a first axis; and means for moving the second end portions of said jaws relative to each other to thereby vary the width of said gap and the size of said opening, including an element mounted in at least one of said second end portions for rotation about a second axis which is at least substantially parallel to said first axis, and cam and follower means for converting rotary movements of said element into substantially translatory movements of said second end portions toward or away from each other.

* * * * *